US005728647A

United States Patent [19]

Ogasawara et al.

[11] Patent Number: 5,728,647

[45] Date of Patent: Mar. 17, 1998

[54] INKSHEET FOR THERMAL TRANSFER PRINTING

[75] Inventors: Hiroaki Ogasawara; Satoru Shinohara; Kei Obata, all of Miyagi, Japan

[73] Assignee: Sony Corporation, Tokyo, Japan

[21] Appl. No.: 691,673

[22] Filed: Aug. 2, 1996

[30] Foreign Application Priority Data

Aug. 10, 1995 [JP] Japan ..... 7-225781

[51] Int. Cl.[6] ..... B41M 5/035; B41M 5/38

[52] U.S. Cl. ..... 503/227; 428/195; 428/500; 428/913; 428/914

[58] Field of Search ..... 428/195, 336, 428/337, 488.4, 500, 913, 914

[56] References Cited

U.S. PATENT DOCUMENTS 4,738,889 4/1988 Suzuki et al. ..... 428/195

*Primary Examiner*—Bruce H. Hess

*Attorney, Agent, or Firm*—Hill, Steadman & Simpson

[57] ABSTRACT

The present invention is to provide a thermal transfer inksheet with excellent antistatic properties and shelf stability, which are given by using a polyvinyl acetal resin of a polyvinyl alcohol unit concentration at 12% by weight or less as the binder of the thermally resistant lubricant layer and by using a tetraammonium salt as the antistatic agent. The thermal transfer inksheet contains a substrate, a thermally transferable ink layer formed on one face of the substrate, a thermally resistant lubricant layer formed on the other face of the substrate which contains a polyvinyl acetal resin and a tetraammonium salt wherein the vinyl alcohol unit concentration in the polyvinyl acetal resin is 12% by weight or less.

12 Claims, 2 Drawing Sheets

INKSHEET FOR THERMAL TRANSFER PRINTING

BACKGROUND OF THE INVENTION

1. Field of the Invention

The present invention relates to a thermal transfer inksheet with a thermally resistant lubricant layer. More specifically, the present invention relates to a thermal transfer inksheet suitable for transfer recording via heat of sublimation.

2. Description of the Prior Art

As the hard copy technique of video image signals, recent attention has been focused on the transfer recording process via heat of sublimation, capable of continuous full-color gradient printing.

By the transfer recording process via heat of sublimation, an image is generally formed by using a thermal transfer inksheet formed with a thermally transferable ink layer on a plastic substrate such as polyester, the ink layer being prepared by dispersing a sublimable (or thermally disperse) dye in a binder resin, along with a printing sheet formed with a dye receiving layer comprising a sublimable dye receiving resin on the substrate. Then, the image formation comprises laying the thermally transferable ink layer on the thermal transfer inksheet on top of the dye receiving layer on the printing sheet, heating the thermally transferable ink layer via a thermal head from the side of the substrate of the thermal transfer inksheet to transfer the dye in the thermally transferable ink layer onto the dye receiving layer on the printing sheet.

So as to improve the rate of image formation, recently, the heating energy of thermal transfer inksheet has been likely to be elevated. So as to prevent the fusion of the thermal transfer inksheet with a thermal head during image formation, therefore, a thermally resistant lubricant layer comprising a thermally resistant resin with a glass transition temperature (Tg) of 80° C. or more, for example a polyvinyl acetal resin, is to be formed on the back face of the substrate. Additionally, the thermally resistant lubricant layer is treated with an antistatic process in order to prevent dust adhesion and the adhesion of the lubricant layer onto a printer transfer system.

Generally, the antistatic treatment of resins comprises blending the resins with a conductive filler such as carbon black or an ionic or nonionic antistatic agent having surfactant actions. For thermal transfer inksheets, conductive fillers preventing optical transmission, such as carbon black, cannot be used in the thermally resistant lubricant layer because photodetecting process is generally used for the detection of positions on the inksheets. Hence, the antistatic treatment of the thermally resistant lubricant layer of the thermal transfer inksheet is generally performed by adding an ionic or nonionic antistatic agent. Not the entirety of an antistatic agent added into the thermally resistant lubricant layer but some of the agent oozing out onto the surface of the thermally resistant lubricant layer, is directly involved in the antistatic effect.

OBJECT AND SUMMARY OF THE INVENTION

For the purpose of improving the thermal resistance and shelf stability of the thermal transfer inksheet, however, use is generally made of resins with Tg of 80° C. or more, such as polyvinyl acetal resin, as the structural resin of the thermally resistant lubricant layer. Therefore, the antistatic agent can hardly ooze out from the inside of the thermally resistant lubricant layer after it is formed. Thus, the antistatic properties of the thermally resistant lubricant layer are not satisfactory, disadvantageously.

For a countermeasure against the problem, an antistatic agent is possibly added at a greater amount, such as at a ratio of 30 to 50 parts by weight to 100 parts by weight of the thermally resistant lubricant layer, but a greater amount of an antistatic agent added to the thermally resistant lubricant layer plasticizes the lubricant layer to deteriorate the film properties, disadvantageously. When thermal transfer inksheets are laid over each other for storage, additionally, interlaminar adhesion occurs between the thermal transfer lubricant layer and the thermally resistant lubricant layer; some sublimable dye may transfer from the thermally transferable ink layer to the thermally resistant lubricant layer, disadvantageously.

The present invention is to overcome the problems of the prior art. It is an object of the present invention to procure satisfactory antistatic effects when an ionic or nonionic antistatic agent is added at an amount within a range of no occurrence of the deterioration of the film properties to the thermally resistant lubricant layer of the thermal transfer inksheet.

The present inventors have found that the above object can be achieved by using a polyvinyl acetal resin containing a specific concentration of polyvinyl alcohol unit as the thermally resistant resin of the thermally resistant lubricant layer of the thermal transfer inksheet and using a tetraammonium salt as an ionic antistatic agent. Thus, the present invention has been achieved.

More specifically, the present invention is to provide a thermal transfer inksheet having a thermally transferable ink layer formed on one face of a substrate and a thermally resistant lubricant layer formed on the other face of the substrate, wherein the thermally resistant lubricant layer contains a polyvinyl acetal resin and a tetraammonium salt and wherein the vinyl alcohol unit concentration is 12% by weight or less in the polyvinyl acetal resin.

DETAILED DESCRIPTION OF THE PREFERRED EMBODIMENT

The thermal transfer inksheet of the present invention will be described hereinbelow in detail with reference to drawings.

Figure 1:
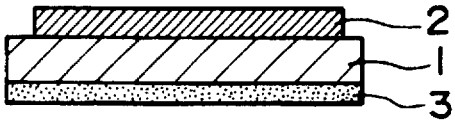
FIG. 1 is a schematic cross sectional view of the thermal transfer inksheet of the present invention.
Figure 2:
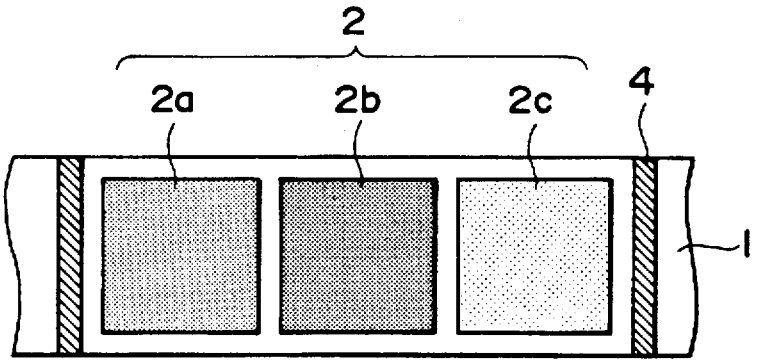
FIG. 2 is a top view of the thermal transfer inksheet of the present invention.

FIG. 1 is a schematic cross sectional view of one example of the thermal transfer inksheet of the present invention. FIG. 2 is a top view of the thermal transfer inksheet of the present invention. The thermal transfer inksheet of the present invention has a structure wherein thermally transferable ink layer 2 is arranged on substrate 1 and thermally resistant lubricant layer 3 is arranged on the back face of the substrate 1.

Figure 3:
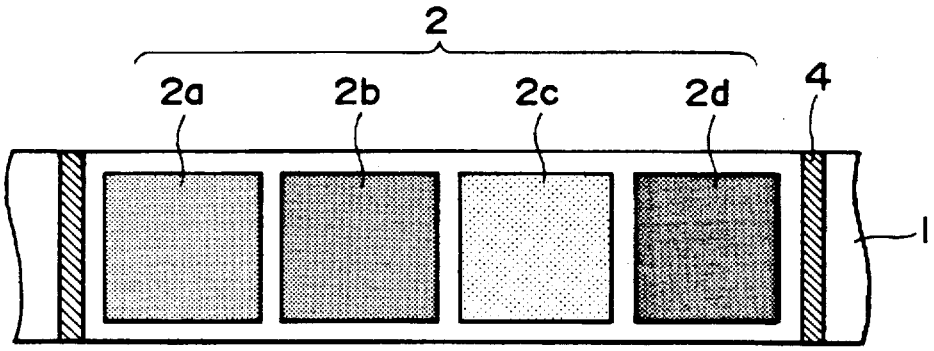
FIG. 3 is a top view of the thermal transfer inksheet of the present invention.
Figure 4:
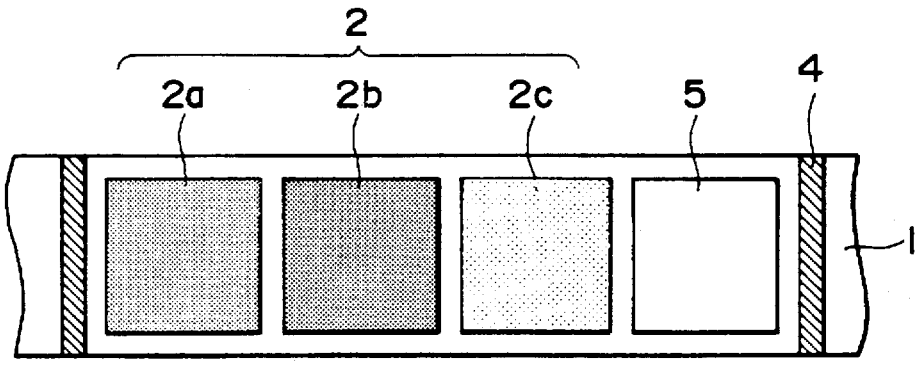
FIG. 4 is a top view of the thermal transfer inksheet of the present invention.
Figure 5:
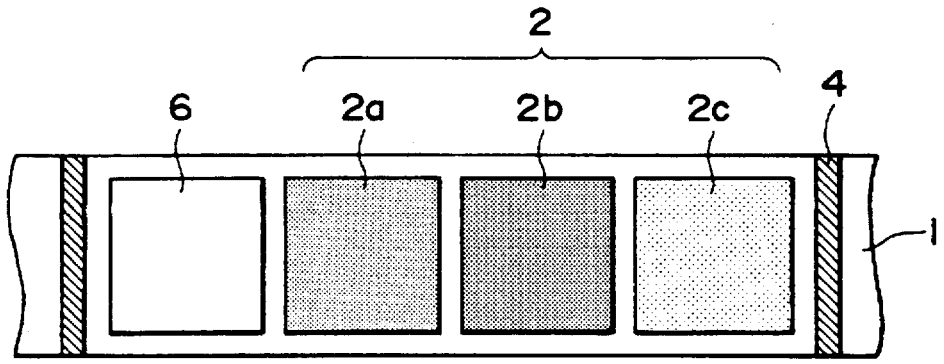
FIG. 5 is a top view of the thermal transfer inksheet of the present invention.

As shown in FIG. 2 (top view) of the thermal transfer inksheet of the present invention, the thermally transferable ink layer 2 is divided into yellow ink layer 2*a*, magenta ink layer 2*b* and cyanogen ink layer 2*c*, with no specific limitation. As shown in FIG. 3, for example, black ink layer 2*d* may also be arranged therein. In such case, sensor mark 4 to detect the position of the thermal transfer inksheet may be arranged on the surface of the substrate 1 on the same side of the thermally transferable ink layer 2. As shown in FIG. 4, additionally, transparent transfer protective layer 5 which is transferred onto the printed image to protect the image after printing, may be arranged on the substrate 1. As shown in FIG. 5, furthermore, thermally transferable dye receiving layer 6 may be arranged on the substrate 1 so as to enable the transfer via heat of sublimation on normal paper.

As has been described above, the thermally resistant lubricant layer 3 of the thermal transfer inksheet of the present invention contains a polyvinyl acetal resin of a 12% by weight or less of the vinyl alcohol unit concentration as the thermally resistant resin, together with a tetraammonium salt as the antistatic agent. The reason why the vinyl alcohol unit concentration should be below 12% by weight in the polyvinyl acetal resin is described hereinbelow. If the alcohol unit concentration exceeds 12% by weight, the antistatic effect of the tetraammonium salt added is deteriorated, involving the increase of the surface resistance of the thermally resistant lubricant layer 3 which causes the layer readily chargeable.

When the concentration of the hydroxyl group is decreased in a resin, the miscibility between the resin and a highly ionic additive such as tetraammonium salt is decreased. If such resin with addition of the additive is prepared into film, hence, the amount of the additive bleeding onto the surface is increased, whereby the antistatic properties of the resulting film is improved. In accordance with the present invention, thus, the vinyl alcohol unit concentration does not have any specific lower limit; in a practical sense, however, the lower limit is essentially determined from the requirement for the production of polyvinyl acetal resins.

As the polyvinyl acetal resins, use may be made of polyvinyl formal resins, polyvinyl acetoacetal resins, polyvinyl propanal resins, polyvinyl butyral resins and the like. Additionally, the molecular weights of the polyvinyl acetal resins are preferably within a range of 50,000 to 200,000.

The tetraammonium salt to be used as the antistatic agent may appropriately be selected from tetraammonium salts conventionally known as antistatic agents, specifically including Arcurd T-50 (manufactured by Lion Corporation.), Electrostripper QN (manufactured by KAO, Corporation.), Catiogen L (manufactured by Daiichi Kogyo Seiyaku, Co. Ltd.), and Statiside (manufactured by ACL, Co. Ltd.).

If the ratio of a tetraammonium salt blended in the thermally resistant lubricant layer 3 is too small, the antistatic properties is unsatisfactory; if the ratio is too large, blocking or dye offset may occur. Therefore, the ratio is preferably 0.1% to 30% by weight, more preferably 1% to 20% by weight.

If necessary, a variety of known lubricants, fillers, cross-linking agents, etc. may be added to the thermally resistant lubricant layer 3. Particularly, the blending of a cross-linking agent is preferable because the blending can improve the film strength of the thermally resistant lubricant layer 3 as a three-dimensional composition.

Lubricants which can be blended into the thermally resistant lubricant layer 3 include known lubricants such as fluid paraffin, fatty acid, fatty acid ester, phosphate ester, silicone oil, perfluoropolyether and the like. The filler includes known inorganic fillers such as silica, talc, clay, zeolite, titanium oxide, zinc oxide, and carbon; and known organic fillers such as silicone resins, Teflon resins, and benzoguanamine resins. Additionally, the cross-linking agent includes polyisocyanate compounds having two or more isocyanate groups within the molecule, for example diisocyanate compounds such as tolylene diisocyanate, 4,4'-diphenylmethane diisocyanate, 4,4'-xylene diisocyanate, hexamethylene diisocyanate, 4,4'-methylene bis (cyclohexylisocyanate), methylcyclohexane-2,4(or 2,6) -diisocyanate, 1,3-di(isocyanate methyl)cyclohexane, isophorone diisocyanate, and trimethylhexamethylene diisocyanate; and the adduct of polyisocyanate (polyisocyanate prepolymer), produced through partial addition reaction of diisocyanate with polyol, for example, the adduct of tolylene diisocyanate reacted with trimethylol propane.

The layer thickness of the thermally resistant lubricant layer 3 is generally 0.1 to 10 μm, with no specific limitation.

Except for the thermally resistant lubricant layer 3, the composition of the present invention may be the same as those of conventional thermal transfer inksheets.

As the binder resin constructing the thermally transferable ink layer 2, for example, use may be made of known binder resins. Such binder resin includes cellulose resins such as methyl cellulose, ethyl cellulose, hydroxyethyl cellulose, hydroxypropyl cellulose and cellulose acetate; vinyl resins such as polyvinyl alcohol, polyvinyl butyral, polyvinyl acetoacetal, polyvinyl acetate, and polystyrene; and urethane resins and the like.

The sublimable or thermally disperse dye contained in the thermally transferable ink layer 2 includes a variety of known dyes for transfer recording via heat of sublimation, for example yellow dyes including azo dyes, disazo dyes, methine dyes, styryl dyes, pyridone azo dyes or the mixture thereof; magenta dyes including azo dyes, anthraquinone dyes, styryl dyes, heterocyclic azo pigments or the mixture thereof; cyanogen dyes including anthraquinone dyes, naphthoquinone dyes, heterocyclic azo pigments, indocyanine dyes or the mixture thereof.

As the substrate 1, use may be made of the same substrate as those for conventional thermal transfer inksheets, including for example plastic films such as polyester film, polystyrene film, polypropylene film, polysulfone film, polycarbonate film, polyimide film, and aramido film; paper and synthetic paper. The thickness of the substrate 1 is generally 1 to 30 μm, preferably 2 to 10 μm.

The thermal transfer inksheet of the present invention may be produced by a routine method. For example, the thermal transfer inksheet can be produced by a method comprising coating a composition for forming a thermally transferable ink layer on one face of a substrate to dry the composition to form a thermally transferable ink layer on one face of a substrate, and subsequently coating onto the back face of the substrate a composition for forming a thermally resistant lubricant layer produced by uniformly dissolving or dispersing a polyvinyl acetal resin and a tetraammonium salt and a variety of additives if necessary, in a solvent, to dry the composition to form a thermally resistant lubricant layer.

The thermal transfer inksheet of the present invention can be used in the same fashion as the inksheet for conventional transfer recording via heat of sublimation.

The thermally resistant lubricant layer of such thermal transfer inksheet of the present invention comprises a polyvinyl acetal resin containing a specific concentration of vinyl alcohol unit and a tetraammonium salt as an antistatic agent.

Thus, sufficient antistatic effects can be brought about with no decrease of the film properties as a thermally resistant lubricant layer.

EXAMPLES

The thermal transfer inksheet of the present invention will now be described hereinbelow with reference to examples.

Examples 1 to 3 and Comparative Examples 1 to 6

(Preparation of Thermal Transfer Inksheet)

The composition for forming a thermally transferable ink layer, as shown in Table 1, was coated to a dry thickness of 1 μm onto one face of a polyester film substrate (Lumilar; manufactured by Toray, Industries Inc.) of a thickness of 6 μm, which was then dried at 120° for 1 minute to form a thermally transferable ink layer.

TABLE 1

| Name of composition | Amount blended (parts by weight) |
|---|---|
| Sublimable dye: Disperse Violet 26 | 5.0 |
| Polyvinyl butyral resin (BX-1; manufactured by Sekisui Chemical Co. Ltd.) | 5.0 |
| Methylethyl ketone | 45.0 |
| Toluene | 45.0 |

Subsequently, the composition for forming a thermally resistant lubricant layer as shown in Table 2 was coated to a final dry thickness of 1 μm onto the back face of the substrate, which was then dried at 120° C. for 1 minute to form a thermally resistant lubricant layer, whereby a thermal transfer inksheet was prepared.

TABLE 2

| Name of composition | Amount blended (parts by weight) |
|---|---|
| Polyvinyl acetal resin (see Table 3) | 5.0 |
| Polyisocyanate cross-linking agent (Coronate L; manufactured by Nippon Polyurethane Industry, Co. Ltd.) | 0.5 |
| Silicone oil (KF6003; manufactured by Shin-Etsu Chemical Co. Ltd.) | 1.0 |
| Silica micropowder (Nipsil E-200A; manufactured by Nippon Silica Industry, Co. Ltd.) | 0.5 |
| Tetraammonium salt | (see Table 3) |
| Methylethyl ketone | 46.0 |
| Toluene | 46.0 |

TABLE 3

| | Polyvinyl acetal resin | PVA concentration* (wt %) | Tetraammonium salt: Component | Tetraammonium salt: Amount blended (parts by weight) |
|---|---|---|---|---|
| Example | | | | |
| 1 | Denka Butyral #3000K (manufactured by Denki Kagaku Kogyo) | 12 | Arcurd T-50 (manufactured by Lion, Corp.) | 1.0 |
| 2 | Denka Butyral #3000K (manufactured by Denki Kagaku Kogyo) | 12 | Statiside (manufactured by ACL) | 1.0 |
| 3 | Denka Butyral #6000AS (manufactured by Denki Kagaku Kogyo) | 9 | Arcurd T-50 (manufactured by Lion, Corp.) | 1.0 |
| Comprative example | | | | |
| 1 | Denka Butyral #3000-2 (manufactured by Denki Kagaku Kogyo) | 19 | Arcurd T-50 (manufactured by Lion, Corp.) | 1.0 |
| 2 | Denka Butyral #5000A (manufactured by Denki Kagaku Kogyo) | 16 | Arcurd T-50 (manufactured by Lion, Corp.) | 1.0 |
| 3 | Denka Butyral #6000EP (manufactured by Denki Kagaku Kogyo) | 16 | Arcurd T-50 (manufactured by Lion, Corp.) | 1.0 |
| 4 | Eslex BX-5 (manufactured by Sekisui Chemical Co. Ltd.) | 14 | Arcurd T-50 (manufactured by Lion, Corp.) | 1.0 |
| 5 | Denka Butyral #5000A (manufactured by Denki Kagaku Kogyo) | 16 | Statiside (manufactured by ACL) | 1.0 |
| 6 | Denka Butyral #5000A (manufactured by Denki Kagaku Kogyo) | 16 | Arcurd T-50 (manufactured by Lion, Corp.) | 2.0 |

Note:
PVA concentration* = (vinyl alcohol unit concentration in polyvinyl acetal resin)

(Assessment)

Individual thermal transfer inksheets produced in Examples 1 to 3 and Comparative Examples 1 to 6, were tested and assessed of their antistatic properties and shelf stability as described below.

(i) Test and Assessment of Antistatic Properties

The antistatic properties of the thermally resistant lubricant layers of the individual thermal transfer inksheets were evaluated on the basis of the electric resistance of the surface. The electric resistance of the surface was measured with a surface electric resistance meter (Megaresta MODEL HT-301; manufactured by Shishido Static Electricity, Co. Ltd.). The measured values are shown in Table 4. A lower surface electric resistance of the thermally resistant lubricant layer is likely to make the layer less chargeable. Practically, the resistance is preferably $1\times10^{12}$ Ω or less. The antistatic properties of the thermally resistant lubricant layers were assessed according to the following assessment standards. The results are shown in Table 4.

| Assessment standards for antistatic properties | |
|---|---|
| Rank | State |
| o: | Surface electric resistance is $1 \times 10^{12}$ Ω or less. |
| x: | Surface electric resistance is $1 \times 10^{12}$ Ω or more. |

(ii) Test and Assessment of Shelf Stability

The shelf stability of each of the thermal transfer inksheets was assessed on the basis of the extent of dye transfer from the thermally transferable ink layer to the thermally resistant lubricant layer. Specifically, each thermal transfer inksheet was laid on top of another thermal transfer inksheet, so that the thermally transferable ink layer was in contact to the thermally resistant lubricant layer at a given size (10 cm×10 cm), prior to loading of 1 kg, followed by storing at 45° C. for 1 week. After the storage, the level of the dye transfer (offset) from the thermally transferable ink layer to the thermally resistant lubricant layer was measured as the reflection concentration with a Macbeth concentration analyzer (TR-924). Then, a lower reflection concentration is more preferable; practically, the reflection concentration is preferably 0.10 or less. Thus, the shelf stability of the thermally transferable inksheet was assessed according to the following assessment standards. The results are shown in Table 4.

| Assessment standards of antistatic properties | |
|---|---|
| Rank | State |
| o: | Reflection concentration ≦ 0.10 |
| x: | Reflection concentration > 0.10 |

TABLE 4

| | Surface electric resistance (Ω) | Antistatic properties | Shelf stability (offset) |
|---|---|---|---|
| Example | | | |
| 1 | $1.15 \times 10^{11}$ | o | o |
| 2 | $2.44 \times 10^{10}$ | o | o |
| 3 | $3.82 \times 10^{10}$ | o | o |
| Comparative Example | | | |
| 1 | $>1.0 \times 10^{13}$ | x | o |
| 2 | $>1.0 \times 10^{13}$ | x | o |
| 3 | $>1.0 \times 10^{13}$ | x | o |
| 4 | $>1.0 \times 10^{13}$ | x | o |
| 5 | $>1.0 \times 10^{13}$ | x | o |
| 6 | $3.20 \times 10^{10}$ | o | x |

Table 4 shows the results that the thermally transferable ink ribbons in Examples 1 to 3 have excellent antistatic properties because the thermally resistant lubricant layers thereof have surface electric resistance values lower than the upper limit of the electric resistance ($1\times10^{12}$ Ω) practically preferable and that the ribbons cause less offset with excellent shelf stability.

The thermally transferable ink ribbons of Comparative Examples 1 to 5 cause less offset of dyes but have larger surface electric resistance values than those of the Examples. Thus, the ribbons are readily chargeable. The thermally transferable ink ribbon of Comparative Example 6 has antistatic properties comparative to those of Examples 1 to 3 because the amount of the antistatic agent added to the ribbon is more than those of other Examples. It is indicated that too much amount of the antistatic agent if added causes the plasticization of the thermally resistant lubricant layer, disadvantageously, to cause the offset of the dye at no negligible extent.

The above results indicate that antistatic properties and shelf stability can be given to a thermal transfer inksheet by using a polyvinyl acetal resin of a polyvinyl alcohol unit concentration at 12% by weight or less as the binder of the thermally resistant lubricant layer and by using a tetraammonium salt as the antistatic agent.

What is claimed is:

1. A thermal transfer inksheet containing:

a substrate, a thermally transferable ink layer formed on one face of the substrate, a thermally resistant lubricant layer formed on the other face of the substrate, containing a polyvinyl acetal resin and a tetraammonium salt wherein the vinyl alcohol unit concentration in the polyvinyl acetal resin is 12% by weight or less.

2. A thermal transfer inksheet according to claim 1, wherein the amount of the tetraammonium salt blended into the thermally resistant lubricant layer is 0.1% to 30% by weight.

3. A thermal transfer inksheet according to claim 1, wherein the molecular weight of the polyvinyl acetal resin is 50,000 to 200,000.

4. A thermal transfer inksheet according to claim 1, containing a lubricant, a filler and a cross-linking agent in the thermally resistant lubricant layer thereof.

5. A thermal transfer inksheet according to claim 1, wherein the layer thickness of the thermally resistant lubricant layer is 0.1 to 10 μm.

6. A thermal transfer inksheet according to claim 1, wherein the layer thickness of the substrate is 1 to 30 μm.

7. A thermal transfer inksheet containing a substrate, a thermally transferable ink layer formed on one face of the substrate, sensor marks formed on one face of the substrate, a thermally resistant lubricant layer being formed on the other face of the substrate and containing a polyvinyl acetal resin and a tetraammonium salt wherein the vinyl alcohol unit concentration in the polyvinyl acetal resin is 12% by weight or less.

8. A thermal transfer inksheet according to claim 7, wherein the thermally transferable ink layer and the sensor marks are arranged alternately.

9. A thermal transfer inksheet according to claim 8, wherein the thermally transferable ink layer comprises three colored layers, namely a yellow ink layer, a magenta ink layer, and a cyanogen ink layer.

10. A thermal transfer inksheet according to claim 8, wherein the thermally transferable ink layer comprises four colored layers, namely a yellow ink layer, a magenta ink layer, a cyanogen ink layer and a black ink layer.

11. A thermal transfer inksheet according to claim 7, wherein a plurality of a cycle of a sensor mark, a thermally transferable ink and a transfer protective layer are formed on the substrate.

12. A thermal transfer inksheet according to claim 7, wherein a plurality of a cycle of a sensor mark, a thermally transferable ink and a dye receiving layer are formed on the substrate.

* * * * *